US005382204A

United States Patent [19]

Green

[11] Patent Number: 5,382,204

[45] Date of Patent: Jan. 17, 1995

[54] SOLAR PHOSPHENE GENERATOR

[76] Inventor: Glenn K. Green, P.O. Box 17997, Boulder, Colo. 80308

[21] Appl. No.: 8,626

[22] Filed: Jan. 25, 1993

[51] Int. Cl.[6] ..... A61B 5/00

[52] U.S. Cl. ..... 607/95; 600/27; 446/175; 446/202; 446/204; 136/291

[58] Field of Search ..... 136/257, 291, 293; 446/175, 202–209, 244; 128/745; 607/88–91, 95; 600/27

[56] References Cited

U.S. PATENT DOCUMENTS

| | | | |
|---|---|---|---|
| 2,810,318 | 10/1957 | Dockhorn . | |
| 2,825,263 | 3/1958 | Dockhorn . | |
| 2,825,264 | 3/1958 | Dockhorn . | |
| 3,049,962 | 8/1962 | Hans-Joachim Denecke . | |
| 3,737,567 | 6/1973 | Kratomi . | |
| 3,763,591 | 10/1973 | Fontana | 446/202 |
| 3,970,371 | 7/1976 | Kaiwa et al. . | |
| 4,044,756 | 8/1977 | Hamilton et al. . | |
| 4,141,178 | 2/1979 | McGraw | 446/210 |
| 4,315,502 | 2/1982 | Gorges . | |
| 4,341,436 | 7/1982 | Kanno et al. | 359/511 |
| 5,145,442 | 9/1992 | Zan | 446/175 |
| 5,237,764 | 8/1993 | Gray | 136/291 |

FOREIGN PATENT DOCUMENTS

| | | | |
|---|---|---|---|
| 3912283 | 12/1989 | Germany | 136/293 |

OTHER PUBLICATIONS

Relaxman ad.

Synergizer I/O Board ad, Seattle Micro Development, P.O. Box 23211, Seattle, Wash. 98102.

MC-Dream Machine ad, Light & Sound Research, Inc.

Synchro-Mind Expander ad, Lifelight Unlimited, 20 Sunnyside Ave., A-194, Mill Valley, Calif. 94941.

MindsEye ad, Synetic Systems, Inc., P.O. Box 95530, Seattle, Wash. 98145.

InnerQuest ad, Psych-Research Inc., 10002 W. Markham, Ste. 200, Little Rock, Ariz. 72205.

*Primary Examiner*—Lee S. Cohen
*Assistant Examiner*—Robert L. Nasser, Jr.
*Attorney, Agent, or Firm*—Rick Martin

[57] ABSTRACT

A phosphene generating toy can be operated either by the user's blowing in a tube or a solar powered motor. In either case a spinning shade oscillates sunlight on the closed eyelids of the user, thereby generating phosphenes. A mini-flute also produces sounds. Safety features to preclude accidental gazing directly into the sun with open eyes include child proof shutters and a spring loaded shutter.

12 Claims, 6 Drawing Sheets

SOLAR PHOSPHENE GENERATOR

FIELD OF THE INVENTION

The present invention relates to hand held toys which are pointed toward a light source while the eyes are closed, thereby generating phosphenes by pulsating external light on closed eyelids.

BACKGROUND OF THE INVENTION

The basic patent describing phosphene generation by pulsating external light on closed eyelids is U.S. Pat. No. 4,044,756 (1977) to Hamilton et al. Hamilton teaches the use of a head mounted disc having a pair of eye holes. A rotating blade rotates at a speed ranging from about one to twenty-five r.p.m. The rotating blade is sized slightly smaller than the eye holes allegedly to avoid flicker sickness.

The commercially available Day-Dreamer toy improves on the Hamilton patent by adding side walls to block out ambient light, a turbine blade, a blow tube to propel the turbine blade and a fully blocked eye hole during the dark cycle.

There exists a danger of using the above inventions to children who cannot read the instructions. The instructions for use tell the user to close his eyes when pointing the toy at a bright light especially the sun. If a child were to emulate his parents actions of looking at the sun with the "Day Dreamer" toy, then the child would naturally keep his eyes open. This can injure the child's eyes since sun rays can injure the retina.

Thus the present invention improves the Day Dreamer toy by adding two safety features to prevent the user from mistakenly looking directly into the sun while using the Day Dreamer. Additionally, a mini flute is designed into the blow tube to add user changeable sounds to the user's experience while generating phosphenes. Finally, a solar powered motor is added to provide automatic spinning of the turbine blade. This avoids the effects of hyperventilation by repeated blowing.

SUMMARY OF THE INVENTION

The main object of the present invention is to improve a phosphene generating toy by adding safety features to prevent accidental direct exposure to the sun.

Another object of the present invention is to improve a phosphene generating toy by adding a solar powered motor, thereby providing automatic operation without blowing into the turbine blade.

Another object of the present invention is to add variable sounds to the phosphene experience by adding holes to the blow tube, thereby creating a mini flute.

Other objects of this invention will appear from the following description and appended claims, reference being had to the accompanying drawings forming a part of this specification wherein like reference characters designate corresponding parts in the several views.

The Day Dreamer toy has been marketed for about five years. Twenty thousand units have been sold. The Day Dreamer is disclosed in FIGS. 1–3. The user blows in a tube while holding the toy against his face, closing his eyes and looking at a bright light. The rotating turbine shade causes pulses of light to strike the user's closed eyelids. Phosphenes are generated.

The improvements add child proof lids to the eye pieces to allow parents to snap the lids shut after use.

Also, a spring release lever is added to force the user to push the lever down during use. This feature will make it difficult for a child to use.

For added enjoyment, a mini flute is created by adding holes to the blow tube.

For automatic operation without blowing, a solar powered motor is added to the front of the toy to spin the turbine shade. Various types of motor speed control are taught. One is a rheostat, a potentiometer, and the other is a sliding panel to block the solar panel.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
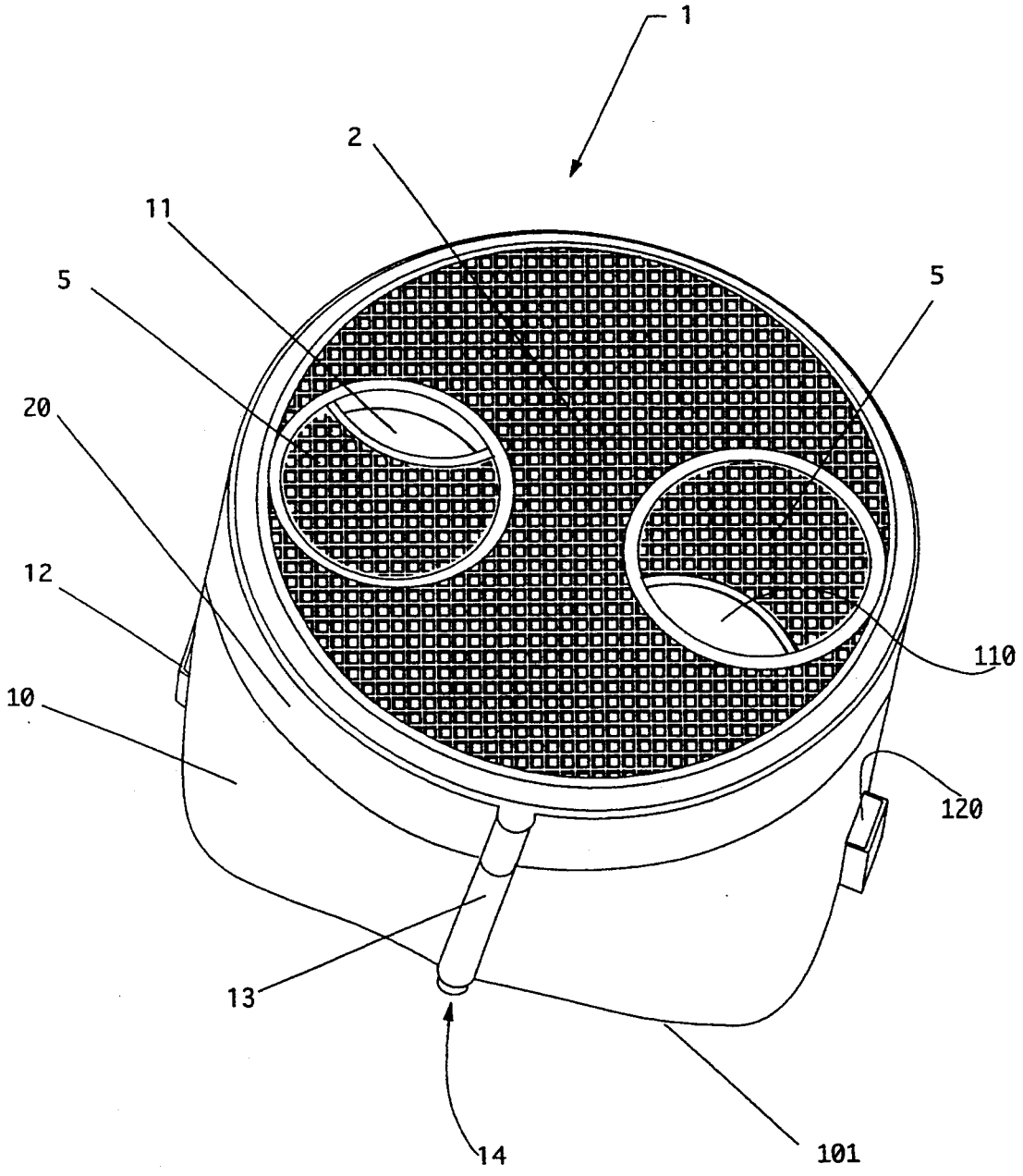
FIG. 1 (prior art) is a top perspective of the Day Dreamer toy, a phosphene generator.

Referring first to FIG. 1 a phosphene generating toy 1 has an inner case 10 which has a contoured lower portion 101 (see also FIG. 3*b*) to fit against the user's face with fasteners 12, 120 and a strap (not shown).

Figure 2A:
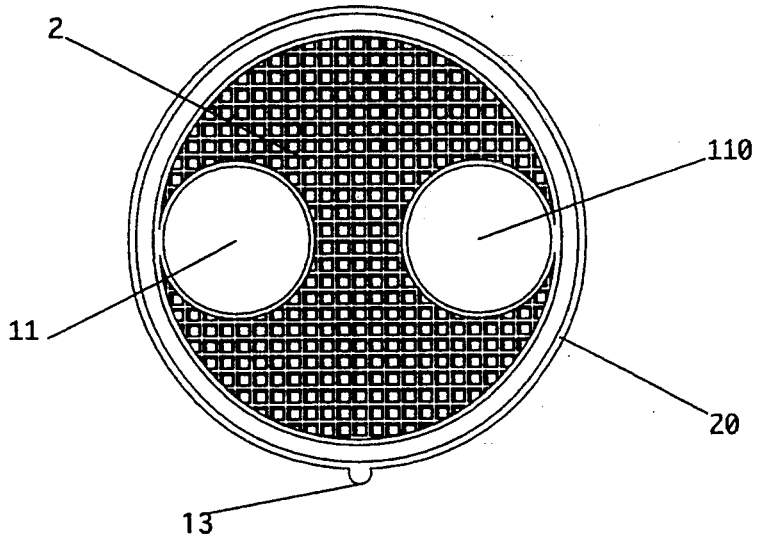
FIG. 2*a* (prior art) is a front plan view of the outer case of the Day Dreamer toy.
Figure 2B:
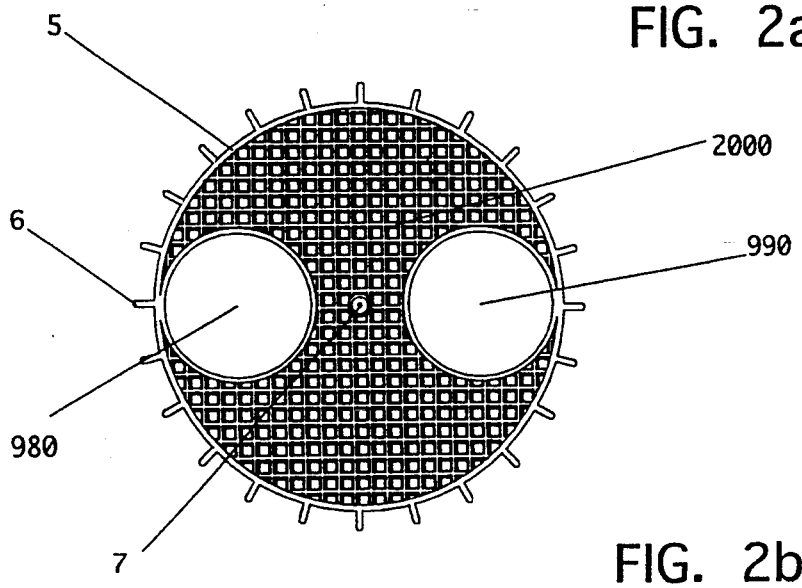
FIG. 2*b* (prior art) is a front plan view of the turbine shade.
Figure 2C:
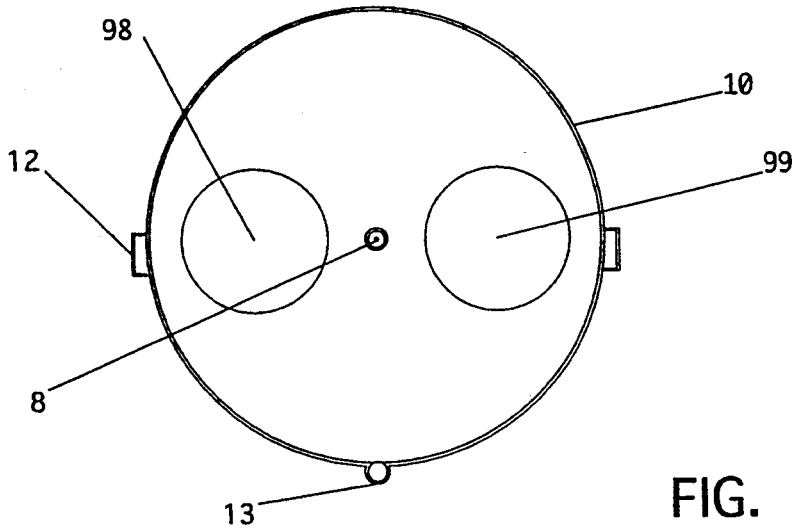
FIG. 2*c* (prior art) is a front plan view of the inner casing of the Day Dreamer toy.
Figure 3A:
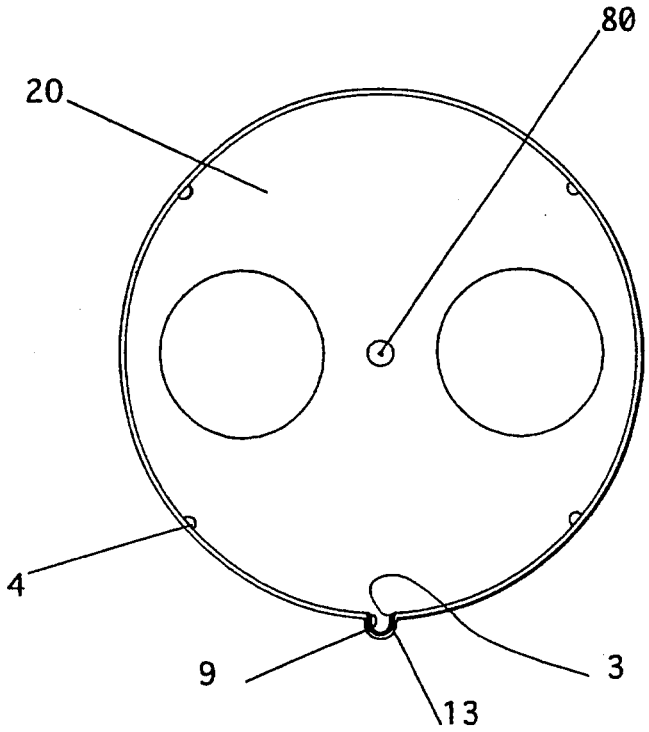
FIG. 3*a* (prior art) is a back plan view of the outer case of the Day Dreamer toy.
Figure 3B:
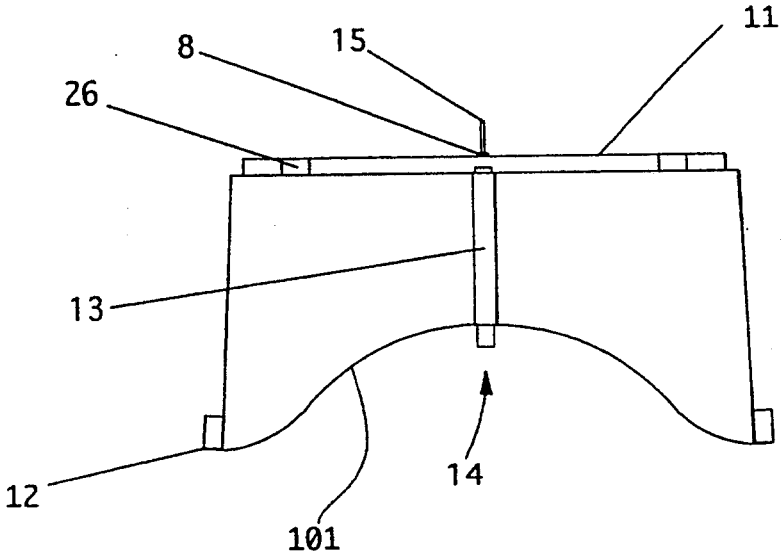
FIG. 3*b* (prior art) is a side plan view of the inner case of the Day Dreamer toy.

The outer case 20 is snap fitted to the inner case 10 by means of male fittings 4 and female fittings 26 (FIG. 3*a*, 3*b*). The outer case 20 has eye holes 11, 110 which align with eye holes 98, 99 of inner case 10 as shown in FIG. 2*c*.

Referring next to FIGS. 2*a*, 2*b*, 2*c*, 3*a*, 3*b* a turbine shade 5 is rotatably mounted between inner case 10 and outer case 20 by means of a pin shaft 15, hole 7, and hubs 8, 80. Blades 6 rotate turbine shade 5 when the user blows into pipe 13 through the mouthpiece 14. Eye holes 980, 990 align with eye holes 11, 110 and 98, 99 in the fully open position. During rotation of turbine shade 5 shade the eye holes 11, 110 and 98, 99 are concurrently oscillated from open to close and gradations thereof as shown in FIG. 1. In operation the toy 1 is pointed at the sun or other bright light source, the eyes are closed, and the user rotates the turbine shade 5 by blowing into the mouthpiece 14. Air is diverted into the blades 6 by means of baffles 3, 9. Phosphenes are generated. Diffractive grating surfaces 2000 create positive interference of incoming light waves and increase various color intensities such as increased red intensity at different angles relative to the light source.

Figure 4A:
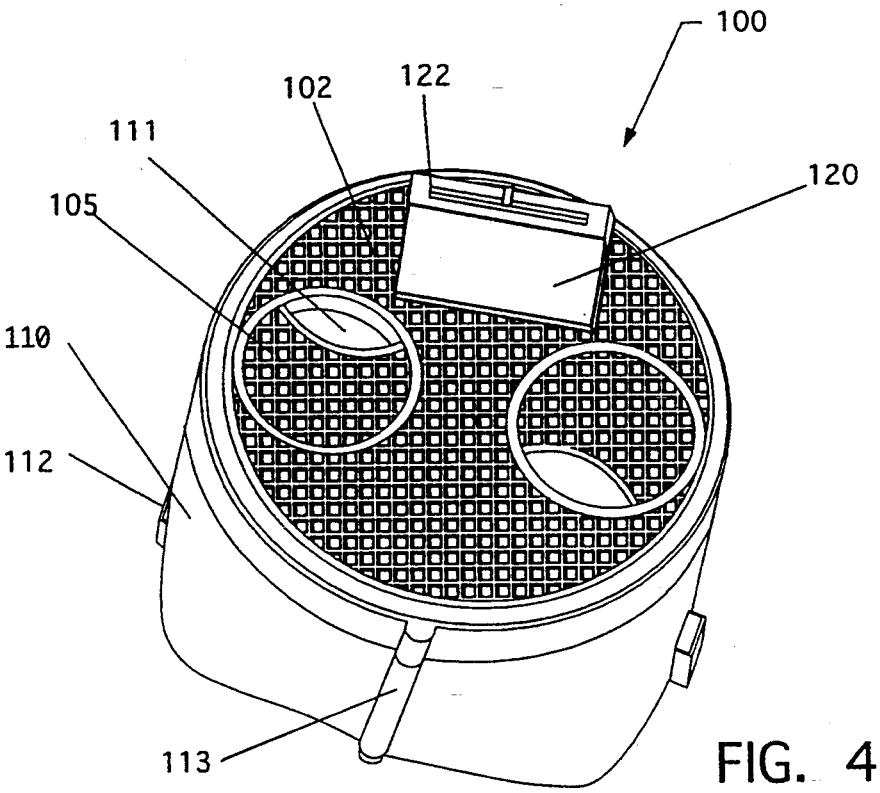
FIG. 4*a* is a top perspective view of an improved Day Dreamer toy having a rheostat controlled solar powered motor.
Figure 4B:
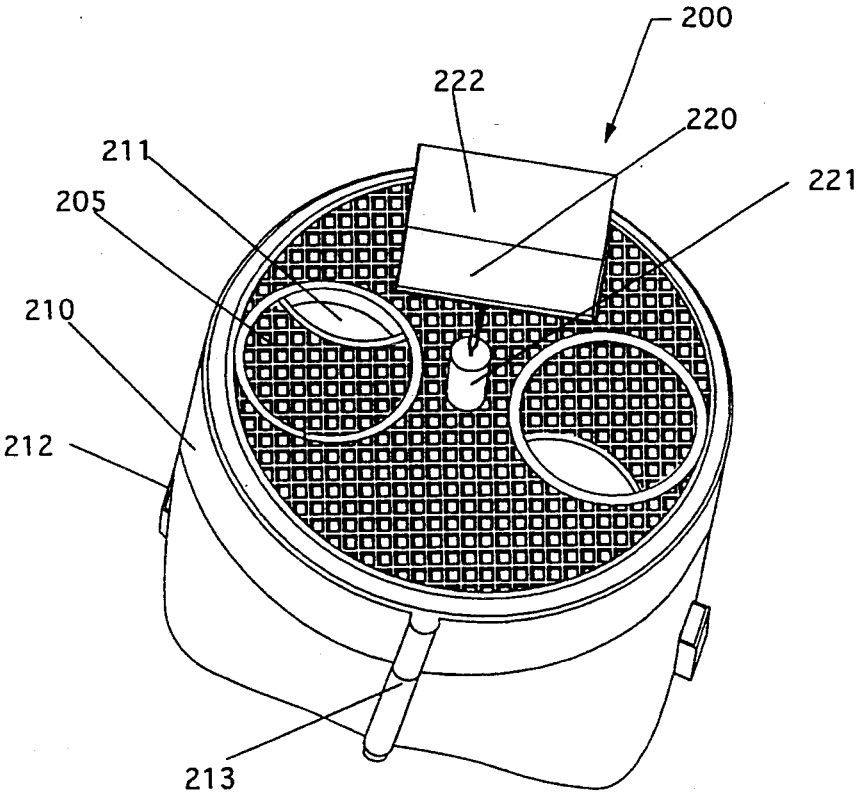
FIG. 4*b* is a top perspective view of an improved Day Dreamer toy having a sliding panel controlled solar powered motor.
Figure 5:
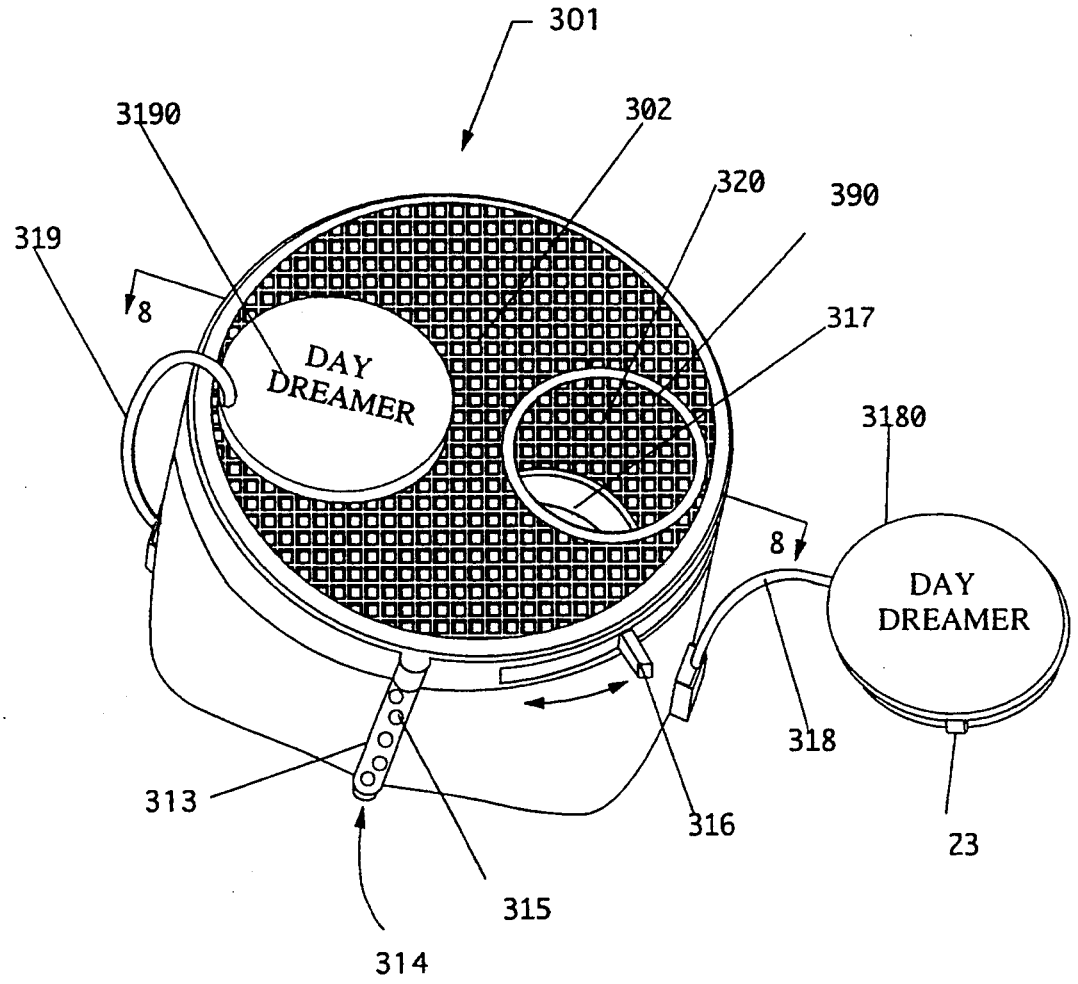
FIG. 5 is a top perspective view of an improved Day Dreamer toy having child proof safety lids, a lever action safety shutter, and a mini flute.

The new improved Day Dreamer toy 100 is shown in top perspective view in FIGS. 4*a*, 4*b*, 5. FIG. 4*a* shows a blow tube 113, strap fastener 112, eye hole 111, and turbine shade 105. The outer case 102 has a solar panel 120 with a rheostat 122 to vary the power output. A knob type rheostat could be used conveniently located on the side. A variable speed motor (not shown) is fitted under the outer case 110. Thus, the turbine shade 105 can either be powered by the variable speed motor or the blow tube 113.

FIG. 4*b* shows an alternative embodiment for a solar powered unit. The toy 200 functions identically as toy 100 in FIG. 4*a*. There is shown a blow tube 213, a strap fastener 212, an outer case 210, a turbine shade 205, an eye hole 211, and a variable speed motor 221. The solar panel 220 has a sliding shade 222 to vary the power to motor 221 and, thus, the speed of turbine shade 205.

Referring next to FIG. 5 safety and sound features are added to a toy 301. It is understood that the solar powered features shown in FIGS. 4*a*, 4*b* could readily be incorporated into the embodiment shown in FIG. 5. A blow tube 313 has a mouthpiece 314. Holes 315 provide variable sounds as the user's fingers play various holes in a known manner.

Two safety features are disclosed in order to prevent the user from looking into the sun with his eyes open. A lever 316 must be depressed in order to move a spring loaded shutter 317 away from blocking the eye hole 390. A turbine shade 320 operates in the identical fashion as the embodiments discussed above.

Figure 6:
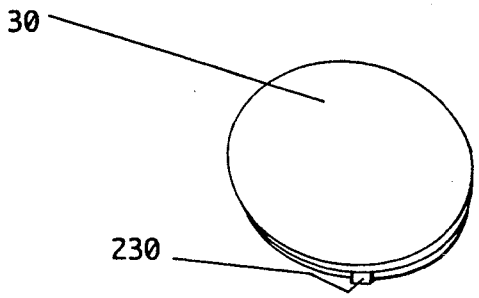
FIG. 6 is a top perspective view of the safety lid shown in FIG. 5.

The second safety feature is a pair of child proof snap on shutters 3180, 3190. Each has a safety strap 319, 318. A child proof lip 23 fits into grooves 24 (refer to FIGS. 6, 7, 8) in a known manner, thereby preventing a child from merely prying the shutters 3180, 3190 off. Shutter 3190 has an opaque surface 18, an elastic middle 21 and an insert 22 with lips 230. In a known manner the shutters 3180, 3190 must be simultaneously pushed and twisted to remove. In a like manner a filter such as a UV or red colored filter could be attached as shown in FIG. 6. Lip 230 is child proof, and surface 30 is a UV filter.

Figure 7:
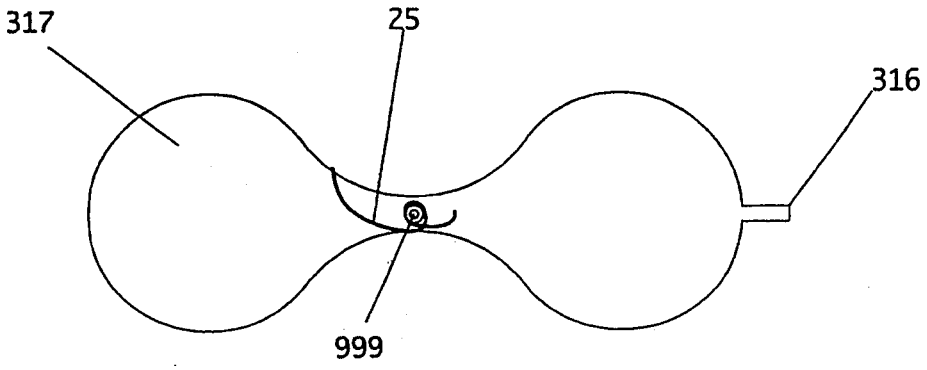
FIG. 7 is a front plan view of the safety shutter.
Figure 8:
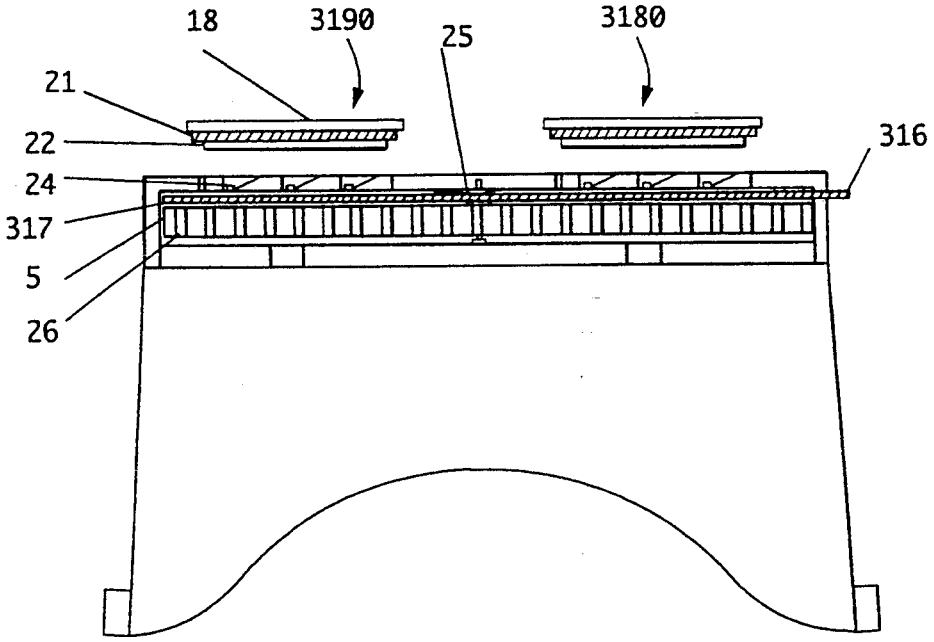
FIG. 8 is across sectional view of the Day Dreamer shown in FIG. 5 taken along line 8—8.

Referring next to FIGS. 7, 8 the spring loaded shutter 317 has a lever 316, a fulcrum 999, and a spring 25. Moving the lever 316 compresses the spring 25 and moves the spring loaded shutter 317 clear of the eye holes 390 (and the like counterpart).

Although the present invention has been described with reference to preferred embodiments, numerous modifications and variations can be made and still the result will come within the scope of the invention. No limitation with respect to the specific embodiments disclosed herein is intended or should be inferred.

I claim:

1. In a phosphene generating toy comprising a case having eye holes, a spinning shade on said case creating alternating light and dark pulses on closed eyelids through the eye holes, and means for rotating the spinning shade, the improvement comprising:

said means for rotating the spinning shade further comprising a solar powered motor having a solar panel; and a spring loaded shutter means mounted over said eye holes, functioning to block the eye holes.

2. The improvement of claim 1 wherein said means for rotating the spinning shade further comprises a turbine blade on said spinning shade, and a blow tube means for propelling said spinning shade.

3. The improvement of claim 1 further comprising means for varying the speed of the solar powered motor.

4. The improvement of claim 3 wherein said means for varying the speed of the solar powered motor further comprises a variable shade over the solar panel.

5. The improvement of claim 3 wherein said means for varying the speed of the solar powered motor further comprises a rheostat.

6. The improvement of claim 1 further comprising child proof snap on opaque safety shutters covering the eye holes.

7. The phosphene generating toy of claim 1 wherein the spring loaded shutter means further comprises a user activated lever functioning to move the shutter to an open position.

8. The toy of claim 1 further comprising a UV and/or colored filter removable affixed to said eye holes.

9. A phosphene generating toy comprising:

a case having eye holes;

a spinning turbine shade in said case creating alternating light and dark pulses on closed eyelids through said eye holes;

a user activated blow tube means functioning to propel said spinning turbine shade;

said user activated blow tube means further comprising noise holes;

said eye holes further comprising child proof shutters connected thereto;

a spring loaded safety shutter means functioning to block said eye holes;

a variable speed electronic motor having a solar panel power means for powering said motor; and said variable speed electric motor further comprising a means connected to said spinning turbine shade functioning to spin said turbine shade.

10. A phosphene generating toy comprising:

a case having eye holes;

a spinning shade on said case functioning to create alternating light and dark pulses on closed eyelids through said eye holes;

said spinning shade further comprising a solar powered motor means having a solar panel, functioning to spin said spinning shade; and a safety closure means mounted over said eye holes, functioning to block the eye holes.

11. The toy of claim 10 wherein said safety closure means further comprises a child proof snap-on shutter having a child proof lip removably engaged on said case.

12. The toy of claim 10 further comprising a UV and/or colored filter having means for removable engagement with said case.

* * * * *